United States Patent [19]

Fransson et al.

[11] Patent Number: 4,930,289

[45] Date of Patent: Jun. 5, 1990

[54] MACHINE FOR PACKING TABLETS INTO TUBES

[75] Inventors: Gosta Fransson, Kalmar; Charles Gorder, Torsas, both of Sweden

[73] Assignee: Gordic Trading AB, Sweden

[21] Appl. No.: 336,708

[22] Filed: Apr. 12, 1989

[51] Int. Cl.[5] ..... B65B 35/30; B65B 35/56; B65B 39/00

[52] U.S. Cl. ..... 53/251; 53/254; 53/532; 53/542; 53/544

[58] Field of Search ..... 53/212, 250, 251, 254, 53/532, 542, 544

[56] References Cited

U.S. PATENT DOCUMENTS

| | | | |
|---|---|---|---|
| 2,829,476 | 4/1958 | Engleson et al. | 53/532 |
| 4,391,560 | 7/1983 | Fardin | 53/532 X |
| 4,712,356 | 12/1987 | Hardage et al. | 53/532 X |
| 4,736,570 | 4/1988 | Hardage et al. | 53/532 X |

FOREIGN PATENT DOCUMENTS 406065 5/1977 Sweden .

*Primary Examiner*—Robert L. Spruill
*Assistant Examiner*—Linda B. Johnson
*Attorney, Agent, or Firm*—Ostrolenk, Faber, Gerb & Soffen

[57] ABSTRACT

A machine for packing tablets into tubes, the machine comprising a filling station (6), a conveyor (2) with pushers to feed tubes intermittently to the filling station and, after filling, to carry the filled tubes away from the station. The filling station (6) includes at least three parallel, rotating rollers (7) arranged to be brought into contact with and rotate at least two tubes closed at one end, the rotating rollers having a specified inclination to the horizontal plane so that the open end of the tube is at a higher level than the closed end, at least two inclined chutes to transfer tablets from a tablet-making machine to the empty tubes, and one supply magazine connected to each supply chute, to raise the tablets to an upright position and transfer them from chute to tube.

10 Claims, 4 Drawing Sheets

Figure 1:
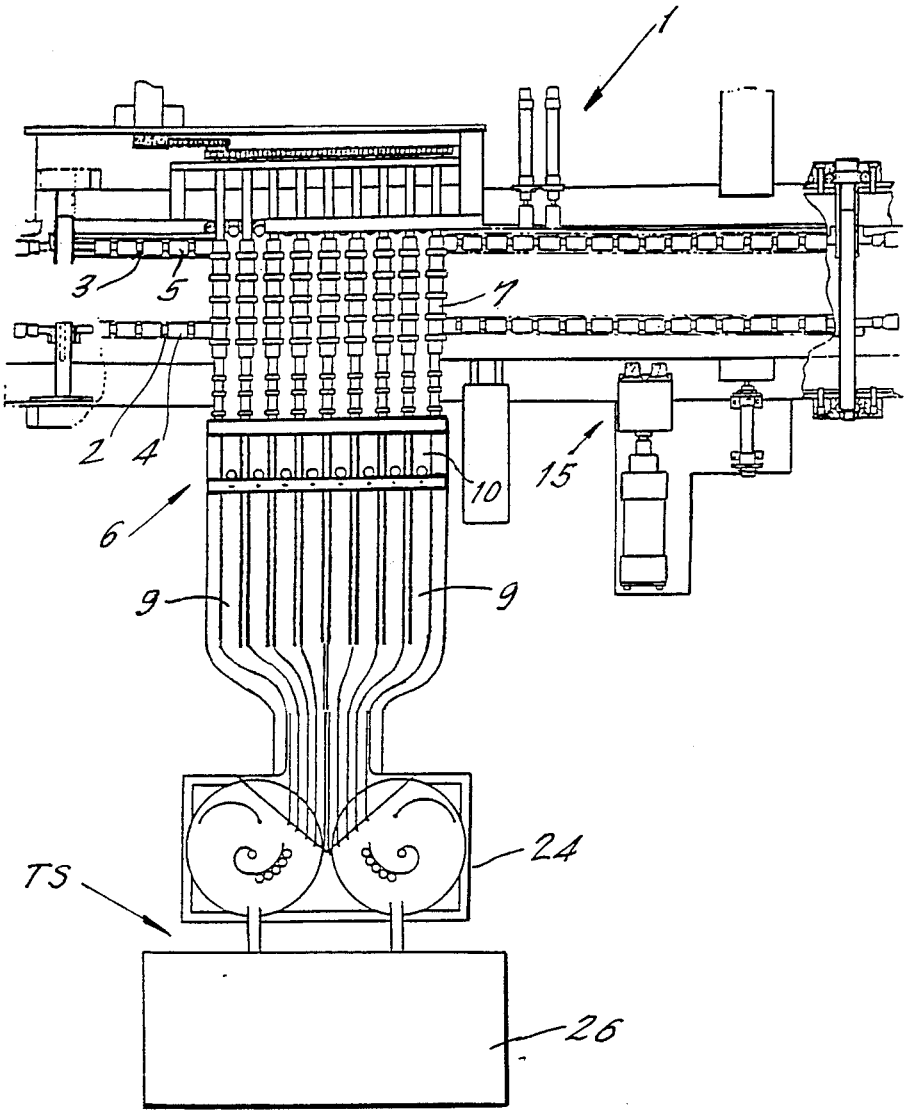

FIG. 3A.
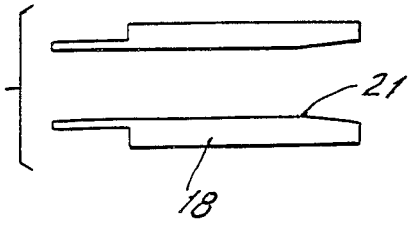
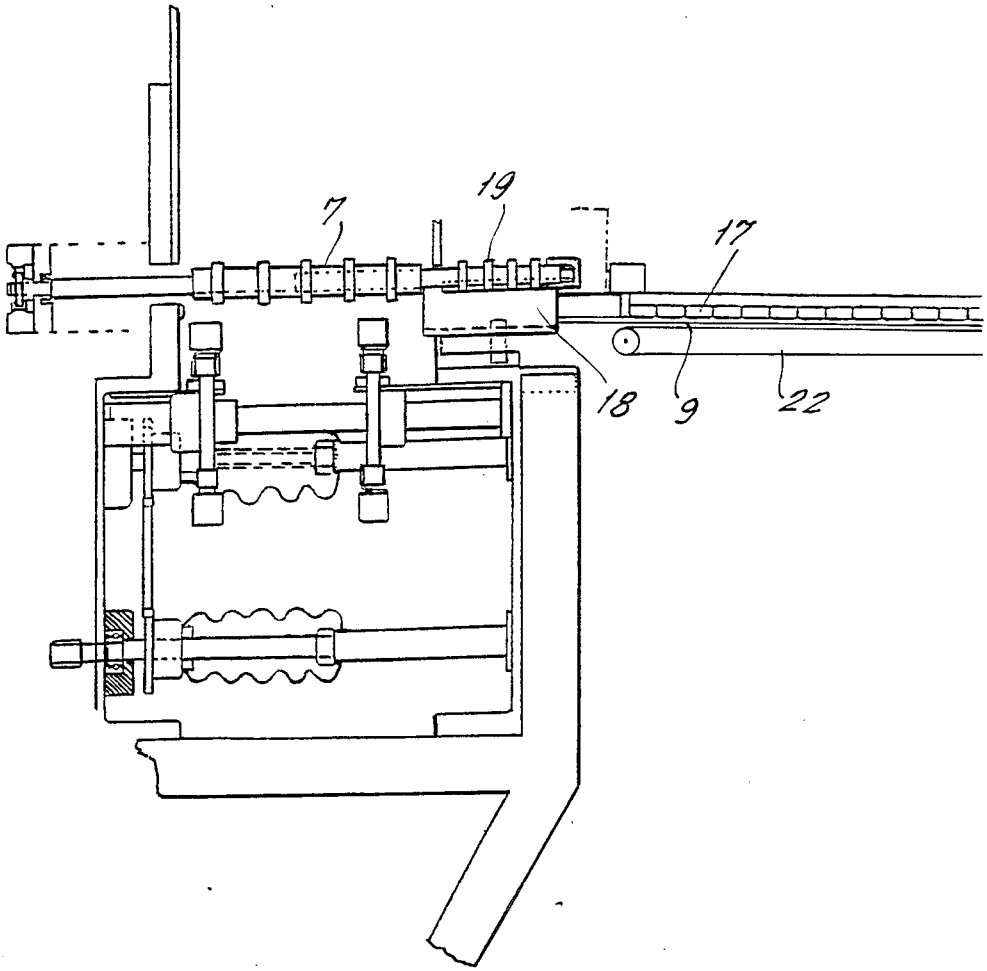
FIG. 3B.

MACHINE FOR PACKING TABLETS INTO TUBES

The present invention relates to a machine for packing tablets into tubes, said machine comprising a filling station and a conveyor with pushers to feed empty tubes intermittently to the filling station and, after filling, to carry the filled tubes to a conveyor for transport away from the station.

Containers for pharmaceutical tablets (such as round, effervescent tablets) in the form of a tube of metal, plastic cardboard or the like, closed at one end, are used to a considerable extent. This is partly thanks to the excellent protection they offer against crushing and breaking of the tablets packed therein. Packing tablets into this type of tube has previously entailed several manual operations, thus increasing the costs.

Tube-filling machines which mechanically orient the tablets and pack them into tubes are known per se. However, these machines have the drawback of being unable to offer sufficiently gentle handling of the tablets. They are also rather complicated, and thus expensive.

A machine for automatically filling tubes is described in SE patent No. 406,065, the machine operating synchronously with a tablet-making machine. The known machine comprises one or more filling stations. At each filling station one tube is filled which is fed from a supply of tubes, to two rotating rollers which rotate the tube during filling. After filling, the tube is placed on a conveyor belt. This machine functions well but is limited in that only one tube can be filled in each filling station.

The object of the present invention is to provide a machine for packing tablets into tubes, which permits at least two tubes to be automatically and gently packed in each filling station.

These and other objects of the invention are achieved by means of the machine described in the introduction which, according to the invention, is characterized in that the filling station includes at least three parallel, rotating rollers arranged to be brought into contact with and rotate at least two tubes closed at one end, the axes of the rotating rollers having a specified inclination to the horizontal plane so that the open end of the tube is at a higher level than the closed end, at least two inclined chutes or a horizontal conveyor with two or more tablet channels which are filled via a distributor arm, to transfer tablets from a tablet-making machine to the empty tubes, and one supply magazine connected to each supply chute, to raise the tablets to an upright position and transfer them from chute to tube.

A great advantage with the machine according to the invention is that two or more tubes can be filled at a single filling station, thus reducing the size and cost of the machine and increasing its efficiency.

According to a suitable embodiment the filling station comprises nine rotating rollers. When the machine is in operation the tubes are fed intermittently to the filling station, the number of tubes which are moved into and simultaneously moved out of the filling station being determined by the number of chutes connected to the filling station. If there are two chutes, then two empty tubes will be moved into the filling station at each step, at the same time as two filled tubes are removed from the filling station.

According to a preferred embodiment of the invention the supply magazine is rotatable and has a cylindrical passage for the tablets. When the tablets slide into the supply magazine, they will be raised to an upright position due to the centrifugal force and will then rotate with their circular periphery against the inner surface of the supply magazine, thereby describing a helical path of movement which continues inside the rotating tubes. The tablets thus enter the tubes with one flat side facing the direction of movement. The tablets are thus not influenced mechanically at all and the rate of reliability in filling the tubes is extremely high.

Figure 2:
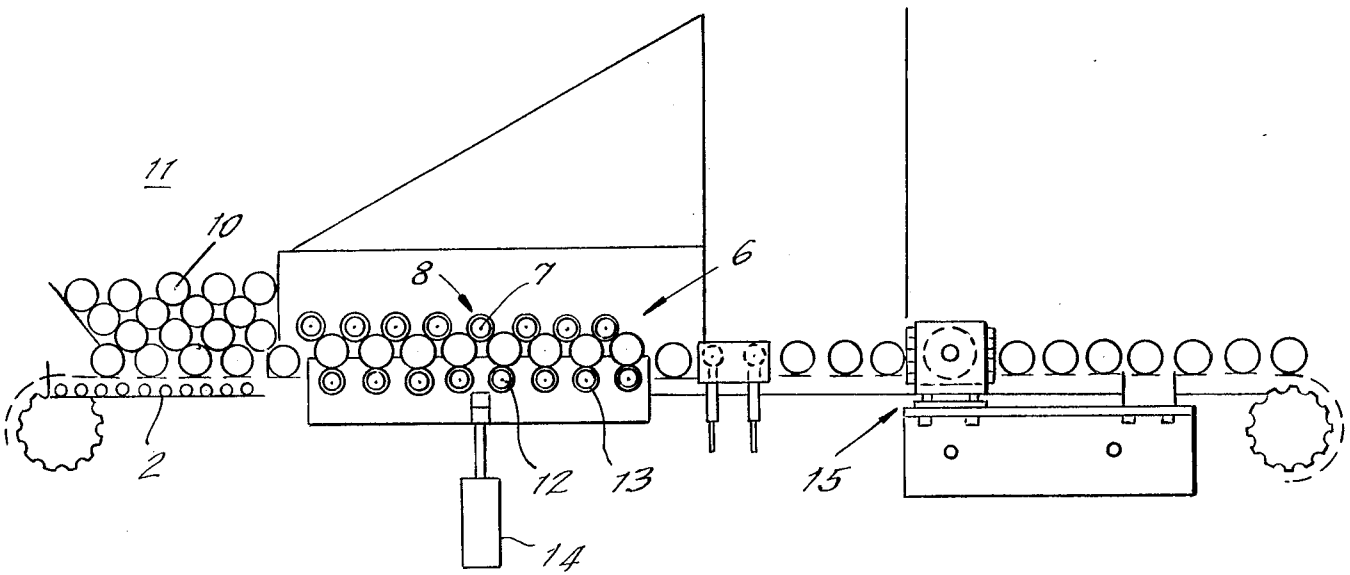

Additional objects, advantages and features of the present invention will be revealed in the following detailed description, with reference to the accompanying drawings, in which FIG. 1 shows a fragmentary view from above of the machine according to the present invention, FIG. 2 shows a fragmentary view from the side of the machine according to the invention, FIG. 3 shows a cross section through the tablet-filling part of the machine, and FIG. 3A shows a cross section through the supply magazine for transferring tablets from chute to tube.

FIG. 3B is similar to FIG. 3, but of an alternative embodiment of the invention.

In FIG. 1 the machine according to the present invention is generally designated 1. Empty tubes are placed in a magazine, parallel to each other, above a conveyor consisting of two chain conveyors 2, 3 with pushers 4, 5 for transporting empty tubes to the filling station, designated 6, and filled tubes away from the filling station. The conveyors run synchronously and are controlled so that the tubes are fed forward intermittently. The number of tubes inserted into and removed from the filling station each time corresponds to the number of supply chutes used.

In the embodiment shown, the filling station 6 comprises nine parallel rotating rollers 7, thus enabling eight tubes to be filled simultaneously. Driving rings 8, e.g. of rubber, are applied on the rollers 7 so that the tubes to be filled will be caused to rotate.

Chutes 9 or a horizontal conveyor 22 (FIG. 3B) for supplying tablets to the filling station 6 are preferably connected directly to a tablet source TS, such as a tablet-making machine 26 and a round faced table 24 and to the tubes to be filled via supply magazines 18, the function of which will be described below. Other parts of the machine may comprise capping station, packing station, etc. However, these will not be discussed in further detail here since they do not affect understanding of the present invention.

FIG. 2 shows a side view of the machine with some parts cut away. Empty tubes 10 are arranged parallel to each other in a container 11 with its opening above the conveyor 2, 3. When empty tubes have been fed into the filling station 6, the conveyor is stopped and in the embodiment shown the tubes are lifted and brought into contact with the rubber rings 8 on the rotating rollers 7, by means of freely running wheels 13 arranged on shafts 12.

This is achieved with the aid of a pneumatically operated piston 14, or in some other suitable manner. When the tubes have been filled, said wheels are lowered and the filled tubes return to their pushers and are removed from the filling station the next time the conveyor moves, at the same time as empty tubes are fed in.

The filled tubes then continue to a capping station generally designated 15, and so on.

FIG. 3 shows a cross section through the filling station comprising a chute 9 for tablets 17, said chute opening into a rotating supply magazine 18. The supply magazine may be rotated by means of drive rings 19 arranged on the rotating shaft 7, as shown in the figure. FIG. 3A shows the entrance 21 of the supply magazine to be funnel-shaped, thus facilitating entry of the tablets into the supply magazine.

The function of the supply magazine is to enable the tablets to slide into said magazine at the enlarged end. The tablets are then raised to an upright position by centrifugal force, so that a flat surface faces the main direction of movement while the tablet moves along the magazine describing a helical path. The machine is so designed that both the supply magazine and the rotating tubes are inclined in relation to the horizontal plane, the rotating tablets thus moving along the magazine and on into the tubes.

The tubes are filled extremely reliably and handling of the tablets is very gentle, thus eliminating any risk of damage to the tablets during the filling operation.

Of course variations and modifications of the machine are feasible without departing from the inventive concept as defined in the following claims.

For instance, in a preferred embodiment the machine is designed so that the rollers intended to rotate during the filling process are inclined approximately 30° to the horizontal plane, while the chute for feeding to tablets from the tablet-making machine to the supply magazine is inclined approximately 40° to the horizontal plane.

What is claimed is:

1. A machine for packing tablets into tubes, said machine comprising a filling station, a conveyor with pushers to feed tubes intermittently to the filling station and, after filling, to carry the filled tubes away from the station, wherein the filling station includes at least three parallel, rotating rollers arranged to be brought into contact with and rotate at least two tubes closed at one end, the rotating rollers having a specified inclination to the horizontal plane so that the open end of the tube is at a higher level than the closed end, a plurality of transfer means for transferring tablets from a tablet source to the empty tubes, and one supply magazine connected to each transfer means, to raise the tablets to an upright position and transfer them from transfer means to tube.

2. A machine as claimed in claim 1, wherein the transfer means are shaped at their upper ends for direct connection to the tablet source.

3. A machine as claimed in claim 1, wherein the filling station comprises nine rotating rollers.

4. A machine as claimed in claim 1, wherein the supply magazine is rotatable in order to raise the tablets to an upright position and to cause them to rotate, a flat side of each tablet thus describing a helical path of movement during entry into the tubes.

5. A machine as claimed in claim 1, wherein the tubes are brought into contact with said rollers by lifting means comprising freely running, vertically movable wheels or rollers arranged on shafts.

6. A machine as claimed in claim 1, wherein the transfer means comprises a horizontal conveyor.

7. A machine as claimed in claim 1, wherein the tablet source is a tablet making machine.

8. A machine as claimed in claim 1, wherein the tablet source is a round feed table.

9. A machine for packing tablets, such as flat, circular tablets, e.g. effervescent tablets, into tubes, said machine comprising a filling station, a conveyor with pushers to feed tubes intermittently to the filling station and, after filling, to carry the filled tubes away from the station, wherein the filling station includes at least three parallel, rotating rollers arranged to be brought into contact with and rotate at least two tubes closed at one end, the rotating rollers having a specified inclination to the horizontal plane so that the open end of the tube is at a higher level than the closed end, supply chutes for transferring tablets from a tablet source to the empty tubes, and one supply magazine connected to each supply chute, to raise the tablets to an upright position and transfer them from chute to tube.

10. A machine for packing flat, circular, effervescent tablets into tubes, said machine comprising a filling station, a conveyor with pushers to feed tubes intermittently to the filling station and, after filling, to carry the filled tubes away from the station, wherein the filling station includes at least three parallel, rotating rollers arranged to be brought into contact with and rotate at least two tubes closed at one end, the rotating rollers having a specified inclination to the horizontal plane so that the open end of the tube is at a higher level than the closed end, a plurality of transfer means for transferring tablets from a tablet source to the empty tubes, and one supply magazine connected to each transfer means, to raise the tablets to an upright position and transfer them from transfer means to tube.

* * * * *